US006997637B2

(12) United States Patent
Schneider et al.

(10) Patent No.: US 6,997,637 B2
(45) Date of Patent: Feb. 14, 2006

(54) DECELERATION-LIMITING ROADWAY BARRIER

(75) Inventors: William C. Schneider, Houston, TX (US); P. James Locke, Houston, TX (US)

(73) Assignee: The United States of America as represented by the National Aeronautics and Space Administration, Washington, DC (US)

( * ) Notice: Subject to any disclaimer, the term of this patent is extended or adjusted under 35 U.S.C. 154(b) by 166 days.

(21) Appl. No.: 10/005,820

(22) Filed: Dec. 4, 2001

(65) Prior Publication Data

US 2002/0085880 A1 Jul. 4, 2002

Related U.S. Application Data

(60) Provisional application No. 60/254,285, filed on Dec. 6, 2000.

(51) Int. Cl.
*E01F 13/00* (2006.01)

(52) U.S. Cl. ..... 404/6; 244/110 R; 256/13.1; 49/34

(58) Field of Classification Search ..... 404/6, 404/9, 10; 244/110 R, 113, 110 A, 110 D, 244/110 F, 110 G, 110 H; 256/1, 13.1; 49/9, 49/34

See application file for complete search history.

(56) References Cited

U.S. PATENT DOCUMENTS

| | | | | |
|---|---|---|---|---|
| 1,855,506 A | * | 4/1932 | Young et al. | 256/13.1 |
| 2,324,726 A | * | 7/1943 | Sawyer | 160/327 |
| 2,854,201 A | * | 9/1958 | Cotton | 244/110 R |
| 3,897,920 A | * | 8/1975 | Di Giovanniantonio et al. | 244/110 C |
| 3,938,763 A | * | 2/1976 | DiGiovanniantonio | 244/110 C |
| 4,143,840 A | | 3/1979 | Bernard et al. | 244/110 |
| 4,231,535 A | | 11/1980 | Schlegel et al. | 244/110 |
| 4,393,996 A | | 7/1983 | Tuman | 244/110 |
| 4,456,205 A | * | 6/1984 | Alavoine et al. | 244/110 C |
| 4,685,656 A | * | 8/1987 | Lee et al. | 256/13.1 |
| 4,759,655 A | | 7/1988 | Gorlov | 404/6 |
| 4,780,020 A | * | 10/1988 | Terio | 404/6 |
| 4,824,282 A | * | 4/1989 | Waldecker | 404/6 |
| 4,979,701 A | | 12/1990 | Colarik et al. | 244/110 |
| 5,022,782 A | | 6/1991 | Gertz et al. | 404/6 |
| 5,071,091 A | | 12/1991 | Kahn et al. | 244/121 |

(Continued)

FOREIGN PATENT DOCUMENTS

EP 0415962 B1 * 8/1993

*Primary Examiner*—Thomas B. Will
*Assistant Examiner*—Alexandra Pechhold
(74) *Attorney, Agent, or Firm*—Theodore U. Ro; James M. Cate

(57) ABSTRACT

Roadway barrier system and method are disclosed for decelerating a moving vehicle in a controlled manner and for retaining the decelerated vehicle. A net or mesh of the roadway barrier system receives and captures the moving vehicle. The net or mesh is secured to anchors by energy absorbing straps. The energy absorbing straps deploy under a tensional load to decelerate the moving vehicle, the straps providing a controlled resistance to the tensional load over a predefined displacement or stroke to bring the moving vehicle to rest. Additional features include a sacrificial panel or sheet in front of the net that holds up the net or mesh while deflecting vehicles that collide only tangentially with the roadway barrier system.

22 Claims, 10 Drawing Sheets

U.S. PATENT DOCUMENTS 5,149,061 A * 9/1992 Borgnini ..... 256/24
5,186,438 A * 2/1993 Cross et al. ..... 256/13.1
5,310,277 A 5/1994 Uotila ..... 404/6
5,407,178 A * 4/1995 Long ..... 256/45
5,524,875 A * 6/1996 Thommen, Jr. ..... 256/12.5
5,829,912 A 11/1998 Marcotullio et al. ..... 404/6

* cited by examiner

DECELERATION-LIMITING ROADWAY BARRIER

CLAIM OF PRIORITY

This application claims priority from, and incorporates herein by reference, provisional application No. 60/254,285, entitled "Energy Absorbing System," filed with the U.S. Patent and Trademark Office on Dec. 6, 2000.

ORIGIN OF THE INVENTION

The invention described herein was made by employee(s) of the United States Government and may be manufactured or used by or for the Government of the United States of America for governmental purposes without the payment of any royalties thereon or therefor.

BACKGROUND OF THE INVENTION

1. Field of the Invention

The present invention relates generally to barrier systems and, more particularly, to deceleration-limiting barrier systems for decelerating moving objects in a controlled manner.

2. Description of the Related Art

Various types of structures and mechanisms have been employed for decelerating or arresting moving objects. In particular, a number of protective barriers and energy dissipating mechanisms have been devised for arresting a moving vehicle.

At racetracks, for example, protective peripheral barrier walls (especially in the curved portions of the track) are frequently made of rigid materials such as reinforced concrete for the purpose of containing a crash vehicle in order to prevent it from deviating from the raceway and colliding with other objects, or with spectators. Such rigid walls or barriers can cause dangerous levels of deceleration ("G" forces) that may kill or severely injure the driver. Similar results may occur with these rigid barriers on public highways where serious injury or death may result when a motorist deviates from the road and collides with a rigid barrier at high velocity.

Deformable barriers have been employed in some instances to help absorb some of the energy involved in a high-speed collision. For example, "barrel" barriers, which typically consist of several crushable 50-gallon drums positioned side-by-side, provide a degree of protection to vehicles and their occupants during an impact by increasing the distance through which the vehicle is decelerated. Other examples of deformable barriers include stacked vehicle tires and bales of hay. While deformable barriers can lessen the "G" forces involved in a crash, such barriers have generally provided sub-optimal impact absorption. Moreover, deformable barriers can create problems of their own, for example, by "catching" the vehicles that strike them tangentially, leading to more severe damage and injuries than would be the case had the vehicle been permitted to skid along the barrier. In addition, if the vehicle crashes into such a barrier at high speed and is not retained by the barrier, the crashed vehicle and attendant debris can be dangerously thrown back into the path of oncoming vehicles, or into the viewing stands.

Accordingly, there is a need for an improved roadway barrier system and, more specifically, a deceleration-limiting roadway barrier system for decelerating the vehicles in a controlled manner and for retaining moving vehicles that collide with the barrier system.

SUMMARY OF THE INVENTION

Embodiments of the invention provide a roadway barrier system and method for decelerating a moving vehicle in a controlled manner and for retaining the decelerated vehicle. A net or mesh of the roadway barrier system receives and captures the moving vehicle. The net or mesh is secured to anchors by energy absorbing straps. The energy absorbing straps deploy under a tensional load to decelerate the moving vehicle, the straps providing a controlled resistance to the tensional load over a predefined displacement or stroke to bring the moving vehicle to rest. Additional features include a sacrificial panel or sheet in front of the net that holds up the net or mesh while deflecting vehicles that collide only tangentially with the roadway barrier system.

In general, in one aspect, the invention is directed to a deceleration-limiting barrier comprising a net, anchors, and a flexible strip arranged to secure the net to the anchors. Portions of the strip are joined together in a manner so as to be susceptible to being pulled apart under a load that is less than a load capacity of the strip.

In general, in another aspect, the invention is directed to a barrier for limiting decelerating of a moving body. The barrier comprises means for receiving and retaining the moving body, means for anchoring the receiving and retaining means, and means for decelerating the moving body in a controlled manner to thereby limit the deceleration thereof to below a predefined maximum deceleration level.

In general, in yet another aspect, the invention is directed to a deceleration-limiting roadway barrier system. The roadway barrier system comprises a first row of barriers positioned end-to-end alongside a roadway, and a second row of barriers positioned end-to-end alongside the first row of barriers, the barriers of the first row being staggered from the barriers of the second row. A plurality of anchors are fixedly mounted in the ground alongside the roadway. Each barrier comprises a net and one or more flexible strips arranged to secure the net to one or more anchors, with portions of each strip joined together in a manner as to be susceptible to being pulled apart under a load that is less than a load capacity of the strip.

In general, in still another aspect, the invention is directed to a method of decelerating a moving body. The method comprises receiving the moving body in a net, deploying a plurality of energy absorbing straps attached to the net, decelerating the moving body using the energy absorbing straps, and limiting the deceleration of the moving body to below a predefined maximum deceleration level.

BRIEF DESCRIPTION OF THE DRAWINGS

A more complete understanding of the system and method of the present invention may be had by reference to the following detailed description when taken in conjunction with the accompanying drawings wherein.

DETAILED DESCRIPTION OF THE DRAWINGS

Figure 1A:
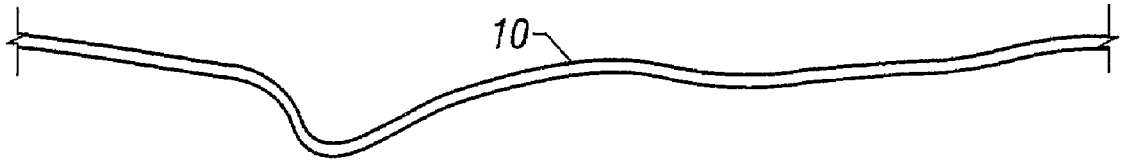
FIGS. 1A–1C illustrate an energy absorbing strap according to some embodiments of the invention.

Following is a detailed description of the drawings wherein reference numerals for similar components and elements are carried forward.

As mentioned previously, embodiments of the invention provide a deceleration-limiting roadway barrier system and method for retaining and decelerating a moving vehicle. The roadway barrier system is designed to limit the amount of deceleration or G force experienced by the moving vehicle to a certain preset level, regardless of how fast the vehicle is traveling at the time of impact. In other words, a faster traveling vehicle will not experience more severe deceleration than a slower traveling vehicle; both vehicles will experience about the same level of deceleration regardless of their respective speeds. The specific deceleration level may be set at a certain maximum as needed to safely bring the vehicles and the occupants therein to a complete stop.

In some embodiments, the deceleration-limiting roadway barrier system comprises two parallel rows of barriers alongside a roadway or racetrack. In the description to follow, the generic term "roadway" is intended to refer both to vehicular roadways and vehicular racing tracks unless otherwise indicted. The barriers in each row are placed end-to-end along the roadway, with the barriers in one row staggered relative to the barriers in the other row. Each barrier is anchored to the ground by ground anchors and includes a net and a flexible, energy absorbing strip arranged so as to secure the net to the anchors. Portions of the flexible strip may be joined to each other in a manner such that the joined portions may be pulled apart under a load which is less than the load capacity of the strip.

FIG. 1A through FIG. 7 is a sequence of sketches that, when taken as a whole, illustrate the construction of a deceleration-limiting roadway barrier system, beginning with the formation of energy absorbing straps and leading up to the assembly of deceleration-limiting barriers and to the installment of those barriers in a roadway barrier system.

Figure 1B:
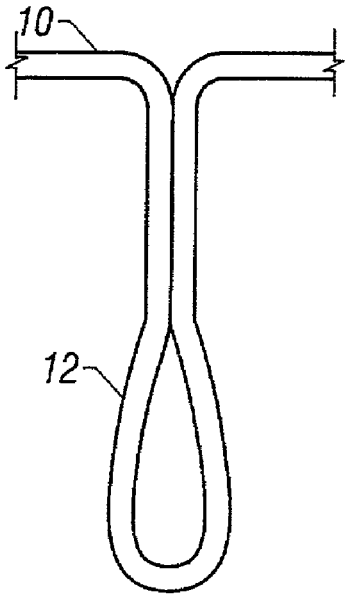

Referring now to FIGS. 1A–1B, an energy absorbing line, strip, or strap 10 is shown. The energy absorbing strap 10 is preferably made of a flexible material having a high tensile strength such as Kevlar™ or Nylon™. In some embodiments, the energy absorbing strap 10 may be folded or otherwise arranged to form a loop 12 in the strap 10. The inner surface of the loop 12 may then be stitched or otherwise joined together with fasteners 14, as disclosed in U.S. Pat. Nos. 5,071,091 and 6,206,155, entitled "Load Limiting Energy Absorbing Lightweight Debris Catcher" and "Energy Absorbing Protective Shroud," respectively, which patents are hereby incorporated by reference.

The fasteners 14 of the loop 12 may be made of threads, cords, or other suitable fasteners, and are selected to have a lower tensile strength than that of the strap 10. The tensile strength of the fasteners 14 and, in part, the pattern in which they are stitched, determine the load required to pull apart the loop 12. It is important that this load be below the load capacity of the strap 10, preferably by at least a certain percentage. Thus, when a load is applied to the strap 10, the fasteners 14 will break or rip away to allow the loop 12 to be pulled apart. In effect, the load on the strap 10 is transferred to the fasteners 14 where it is absorbed and dissipated when the fasteners 14 break and rip away. The load capacity of the strap 10 will therefore not be reached or exceeded regardless of how large a load is applied provided there are enough fasteners 14 in the loop 12 to absorb the load.

It should be noted that, although the term "loop" is used herein, in general, any portion of the energy absorbing strap 10 may be joined to any other portion or portions of the strap 10 regardless of whether a "loop" is formed. Thus, in addition to a loop 12 being formed in the energy absorbing strap 10, a figure "S" shape, for example, or some other configuration may also be formed and stitched together in the strap 10.

Figure 1C:
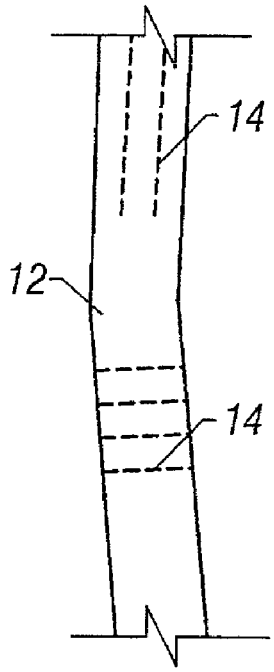

FIG. 1C illustrates a close-up view of a front face of the loop 12 formed in the energy absorbing strap 10. As can be seen, one or more rows of fasteners 14 (e.g., threads or cords) may be stitched into the loop 12 longitudinally along the loop 12, or laterally across the loop 12, or a combination of both, or some other pattern (e.g., diagonally). Depending on the spacing of the rows, the longitudinal stitches may provide a somewhat smoother and more continuous release than the lateral stitches as the loop 12 is pulled apart. Where lateral rows of stitches are used, the fasteners 14 are designed so as to break or rip away an entire row at a time as the loop 12 is pulled apart.

Figure 2A:
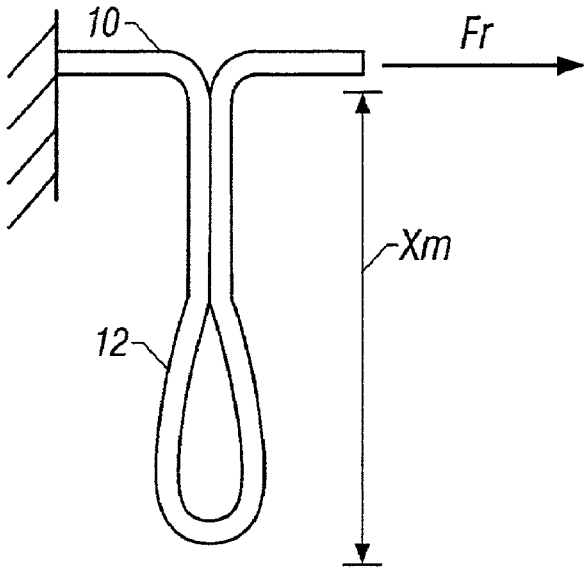
FIGS. 2A–2B illustrate the load that can be absorbed by a loop of the energy absorbing strap according to some embodiments of the invention.
Figure 2B:
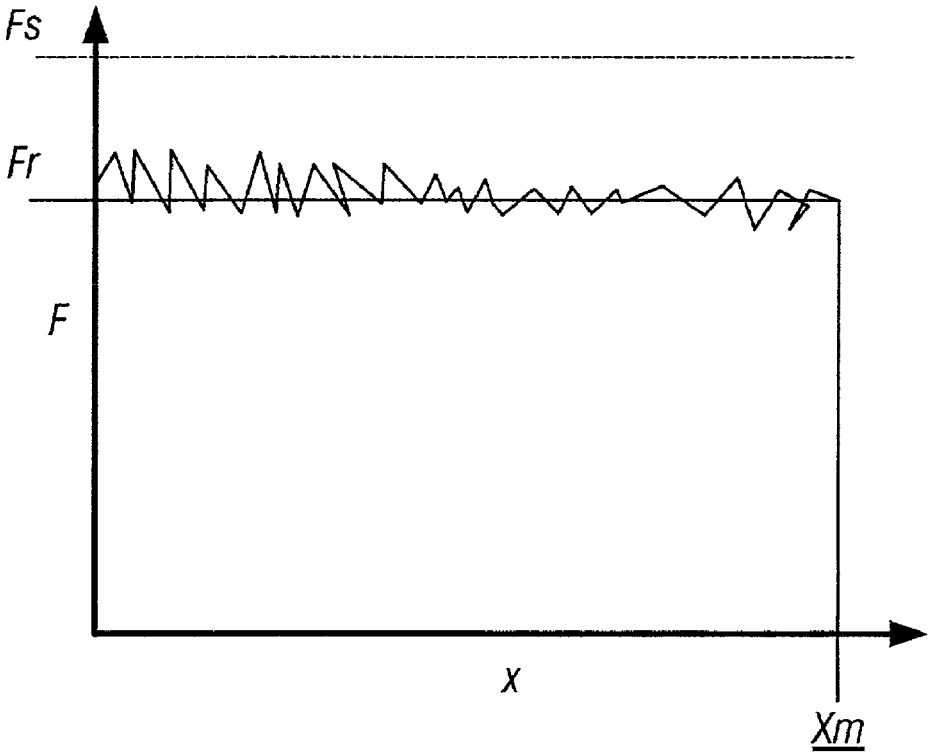

The energy absorbing characteristic of the strap 10 is illustrated in FIGS. 2A–2B, wherein Fs represents the load capacity of the strap 10, Fr represents the load at which the loop 12 will be pulled apart, and Xm represents the stroke or displacement provided by the loop 12. In general, Xm is equal to the length of the joined or stitched portions of the loop 12, which may be the entire loop 12 or only a portion thereof. As can be seen in the graph of load F versus displacement X, the moment that the load reaches Fr, the loop 12 is pulled apart as the fasteners 14 begin to break and rip away. The loop 12 continues to be pulled apart at approximately Fr (shown by the jagged line) as the fasteners 14 break and rip away under the stress of the load. Thus, the load is maintained near Fr because the instant it exceeds Fr by any substantial amount, more fasteners 14 will break or rip away, and the loop 12 is pulled further apart. This process continues until there is no longer a loop 12 (i.e., when X=Xm) or until the load has been sufficiently absorbed. Therefore, the strap 10 will not break regardless of the magnitude of the applied load because the maximum load that is actually placed on the strap 10 will be below its load capacity Fs as long as the stroke Xm of the loop 12 is sufficiently large. The total load absorbed by the loop 12 may be expressed by Equation (1):

$$\text{Load}=Fr\cdot Xm \tag{1}$$

Note that, although the total absorbed load depends on both the Fr and Xm terms, the rate of absorption (i.e., how fast the load is absorbed) depends primarily on the Fr term. For purposes of the roadway barrier system of the present invention, a lower Fr translates to a more gentle deceleration, which will necessitate a larger stroke Xm, and vice versa.

Figure 3A:
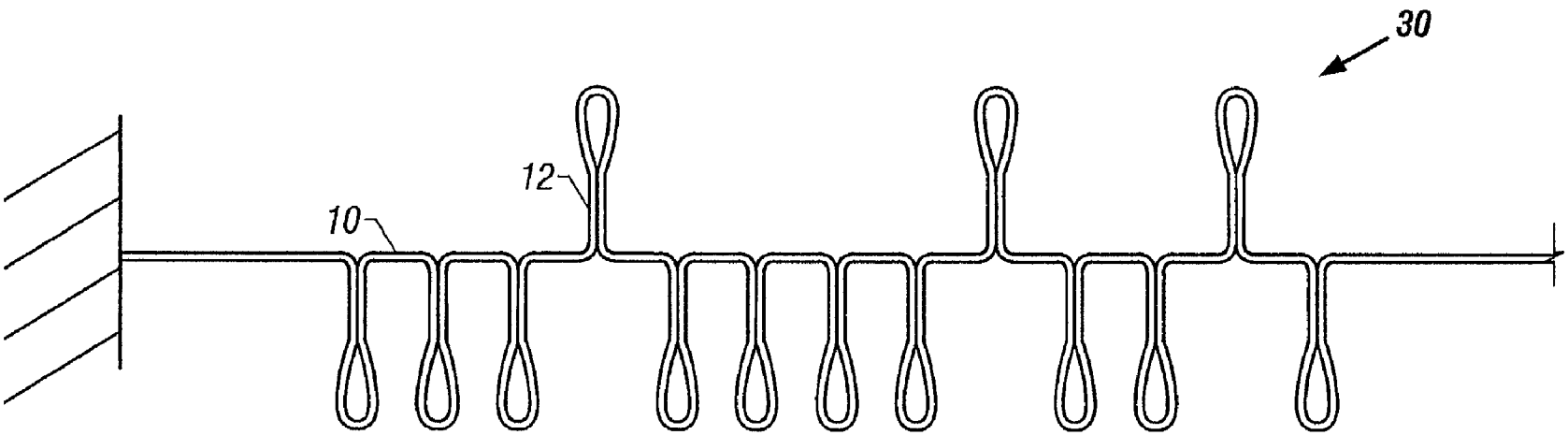
FIGS. 3A–3B illustrate the load that can be absorbed by multiple loops of the energy absorbing strap according to some embodiments of the invention.
Figure 3B:
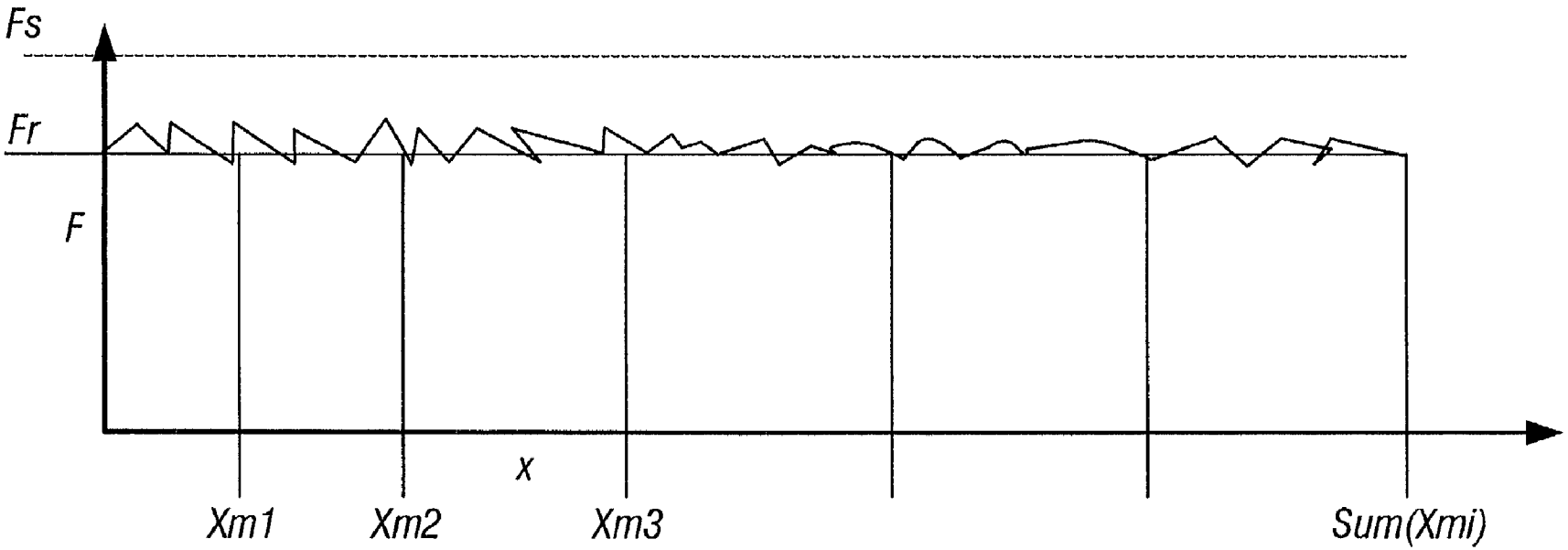

FIGS. 3A–3B illustrate a deceleration-limiting lanyard 30 that may be used in the roadway barrier system according to some embodiments of the invention. As can be seen, the deceleration-limiting lanyard 30 has multiple loops 12 formed therein instead of just one. The multiple loops 12 may be formed by connecting several single-loop energy absorbing straps together in series, or by forming several loops 12 in one energy absorbing strap, or a combination of both. In any case, the load capacity of the lanyard 30 is the sum of the load capacity of each loop 12 in the lanyard 30. This load capacity may be expressed by Equation (2):

$$\text{Load}=Fr\cdot(Xm1+Xm2+Xm3+\ldots+Xmi) \quad (2)$$

where the sum of Xm1, Xm2, Xm3, . . . , Xmi represent the total stroke provided by the individual loops 12 in the lanyard 30. Note that every loop 12 may have the same stroke Xm, or one or more loops 12 may have a different stroke Xm, depending on the requirements of the particular application.

In some embodiments, each loop 12 of the lanyard 30 may be designed so as to be pulled apart under the same load Fr, thereby providing the lanyard 30 with a substantially constant level of deceleration. Thus, regardless of the velocity of the vehicle (e.g., 50, 100,or 150 mph) at the time of impact with the roadway barrier system, the deceleration of the vehicle will be limited to some constant, preselected level. The higher velocity will, of course, require a longer stroke or displacement Xm to decelerate.

In other embodiments, however, one or more of the loops 12 may be designed so as to require a different (e.g., greater or lesser) load to pull these loops apart, so long as all or most of the loops can be pulled apart with a load Fr that is lower than the load capacity Fs of the lanyard 30. For example, the first loop may be designed to be pulled apart under a load Fr1 which is less than a load Fr2 required to pull apart the next loop, and so on in the series of loops. Thus, the lanyard 30 may provide a gentle deceleration initially as the weaker loops are pulled apart first, then increased deceleration as the stronger loops are pulled apart later. Such an arrangement may be useful where there is limited space available for bringing the vehicle to rest. As the vehicle approaches the end of the available space, the stronger loops can provide increased deceleration to quickly bring the vehicle to rest.

Figure 4A:
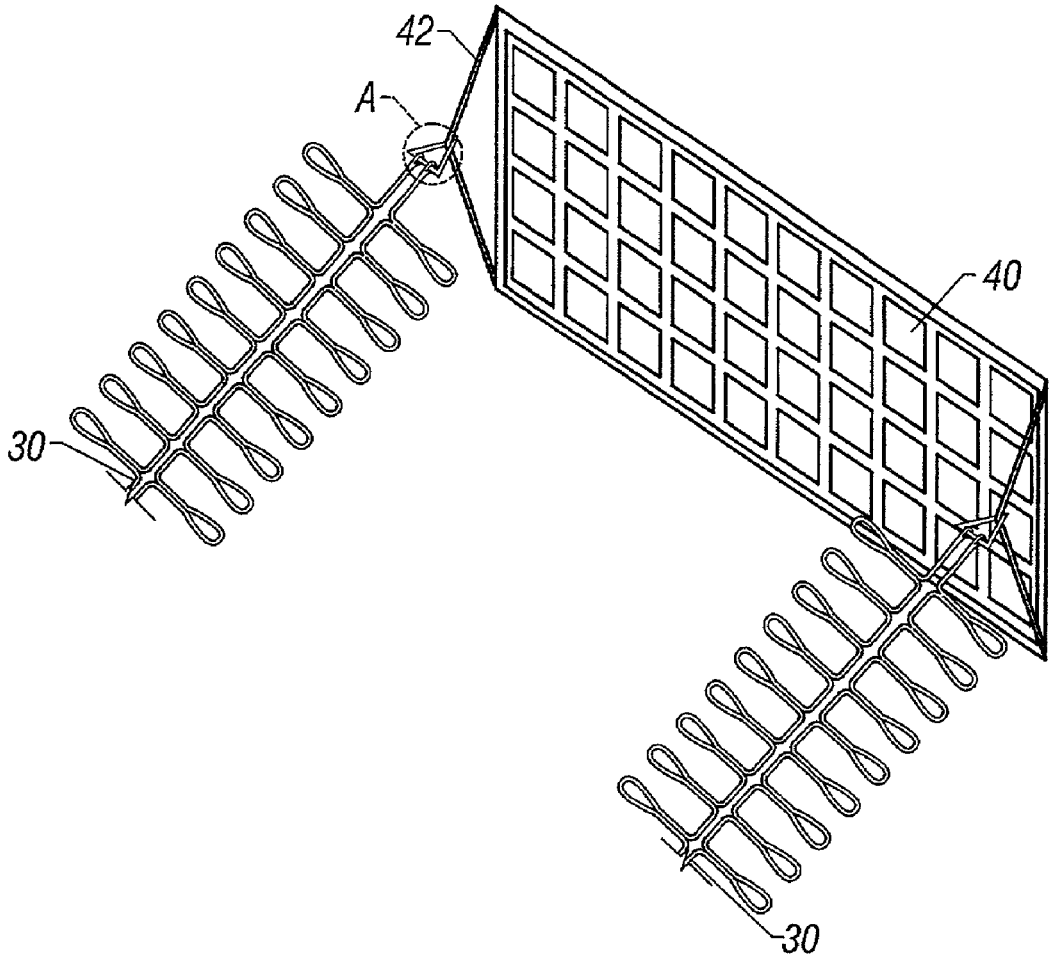
FIGS. 4A–4B illustrate the energy absorbing strap attached to a net according to some embodiments of the invention.

Turning now to FIG. 4A, in some embodiments, the roadway barrier system of the present invention includes a high strength capture mesh or net 40. The net 40 may be a simple, ordinary net that, like the lanyards 30, is made of a flexible high-strength material such as Kevlar™ or Nylon™. Each of the opposing end portions of the net 40 may be attached, tied, connected, or otherwise secured by one or more lanyards 30 to an anchor (shown in FIG. 6). Alternatively, multiple lanyards 30 may be used in parallel, depending on the load capacity required.

Figure 4B:
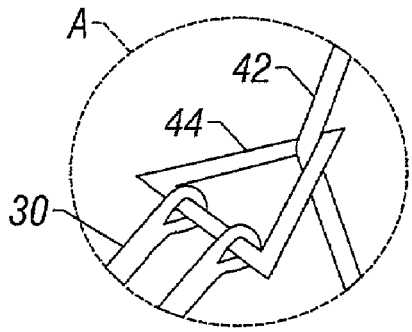

In some embodiments, the lanyards 30 may be connected to the net 40 via load lines 42 that are also made of a high-strength material such as Kevlar™ or Nylon™. FIG. 4B shows a close-up view of the load lines 42 of the net 40 being secured to the lanyards 30 through an optional load ring 44. As can be seen, each of the lanyards 30 and the load line 42 are routed through the load ring 44 to provide a secure connection between the lanyards 30 and the load line 42.

Figure 5:
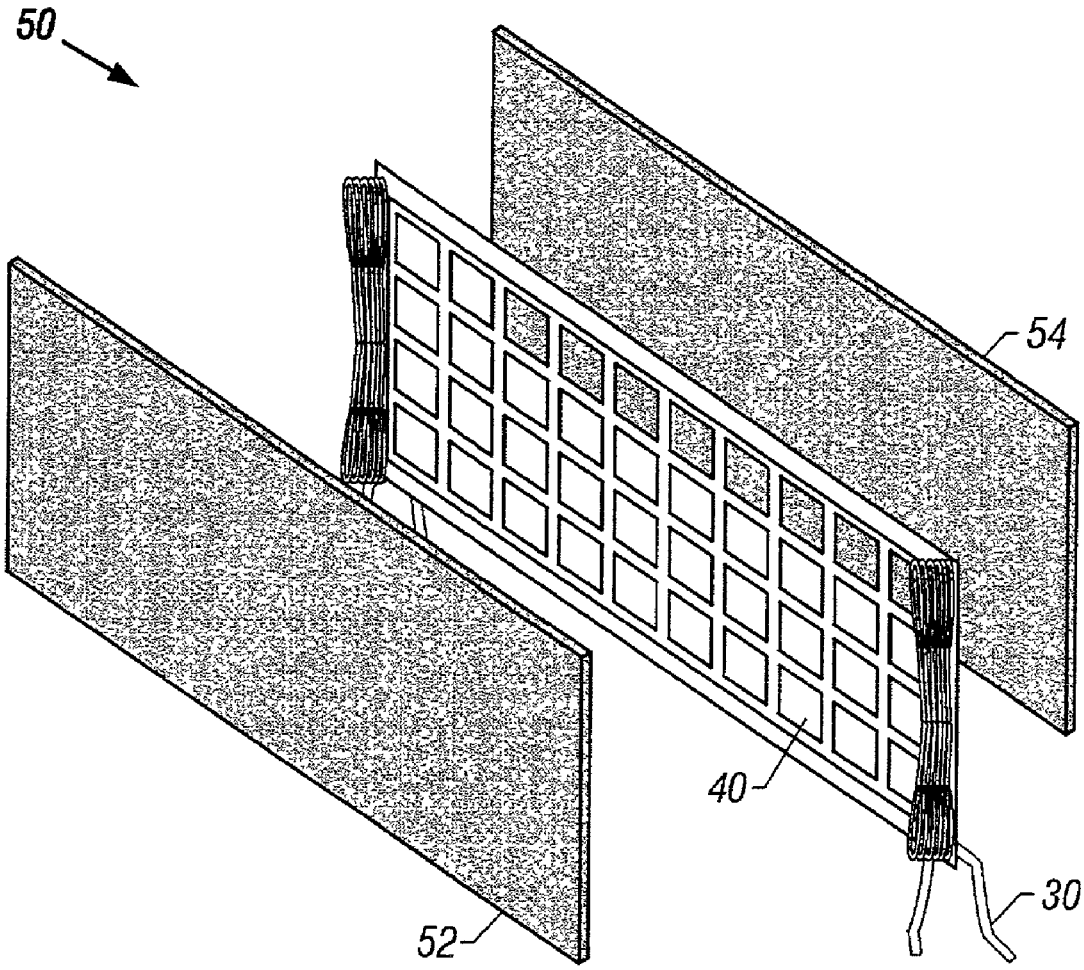
FIG. 5 illustrates a deceleration-limiting barrier according to some embodiments of the invention.

FIG. 5 is an exploded view of a deceleration-limiting barrier 50 according to some embodiments of the invention. The barrier 50 includes a front sacrificial panel 52 that can be used to hold up the net 40. In some cases, the barrier 50 may also include a back sacrificial panel 54 that is used together with the front sacrificial panel 52 to hold up the net 40. The front sacrificial panel 52 may be made of a thin layer of epoxy, concrete, plywood, or other similar material that can be broken apart upon impact, and the back sacrificial panel 54 may be made of the same material or an even lighter material such as a foam material.

During assembly of the barrier 50, the lanyards 30 and the load lines 42 are folded or otherwise tucked onto the net 40, as shown, such that only the loose ends of the lanyards 30 are exposed. This assembly is then sandwiched between the front and back sacrificial panels 52 and 54 for support. The entire assembly may then be sealed, glued, or otherwise adhered together into a single barrier 50.

Figure 6A:
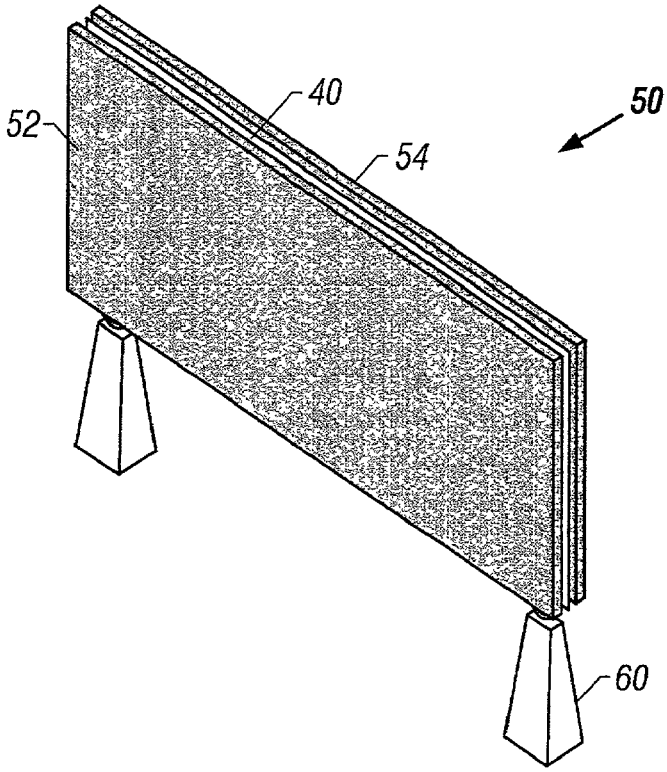
FIGS. 6A–6B illustrate the deceleration-limiting barrier secured to an anchor according to some embodiments of the invention.
Figure 6B:
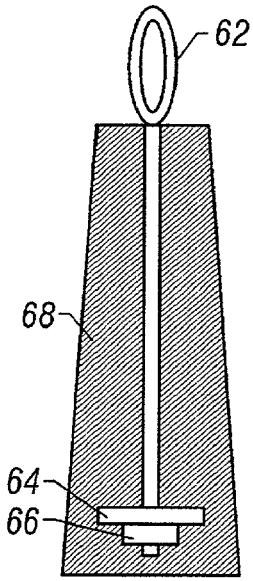

The assembled barrier 50 may then be attached, tied, connected, or otherwise secured via the ends of the lanyards 30 to ground anchors 60, as shown in FIGS. 6A–6B. The ground anchors 60 may be, for example, blocks of concrete, steel, or other heavy material, and may be embedded in or otherwise secured to the ground with sufficient strength to support an impact with a high speed vehicle. In some embodiments, each of the ground anchors 60 may be constructed with an eyehook bolt 62 embedded in a concrete cone 68, with a washer 64 and a nut 66 to secure the eyehook bolt 62 in the cone 68.

Figure 7:
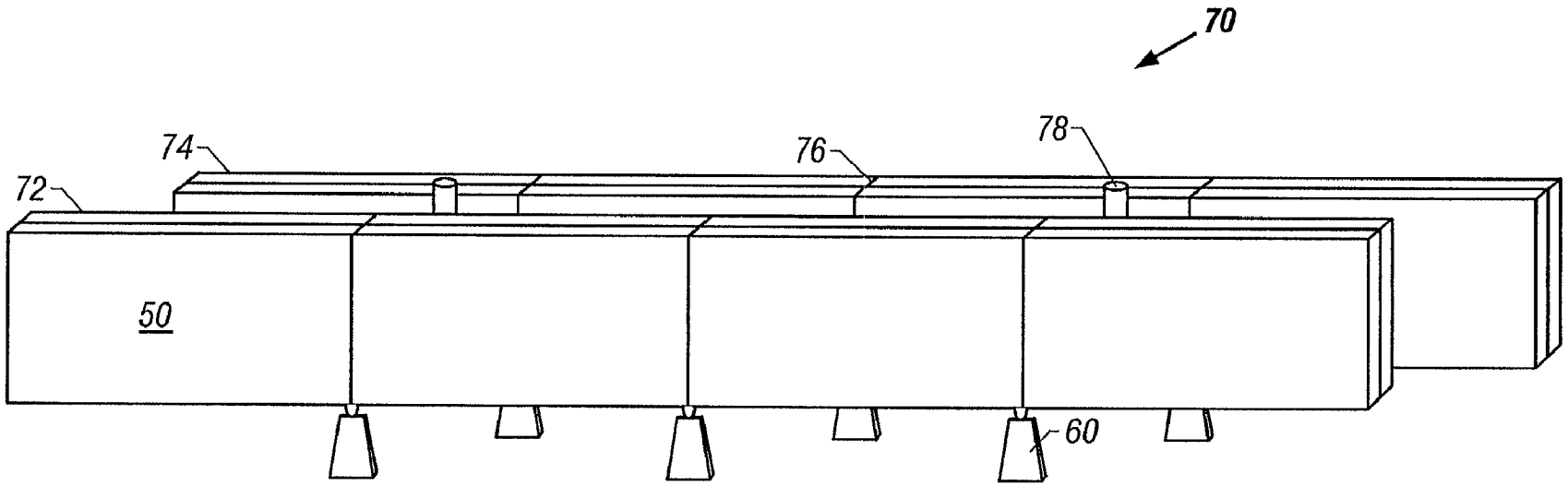
FIGS. 7 illustrates a deceleration-limiting roadway barrier system according to some embodiments of the invention.
Figure 8A:
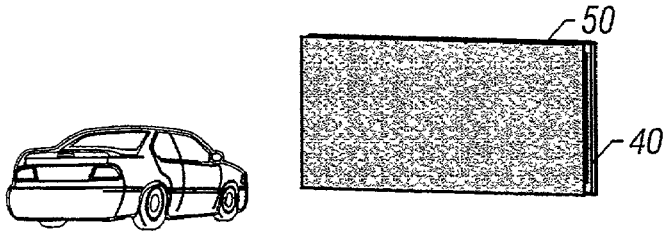
FIGS. 8A–8D illustrate a progressive view of a vehicular crash into the deceleration-limiting roadway barrier system according to some embodiments of the invention.
Figure 8B:
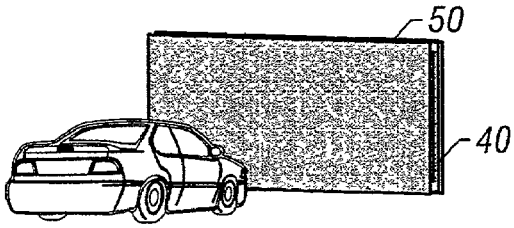
Figure 8C:
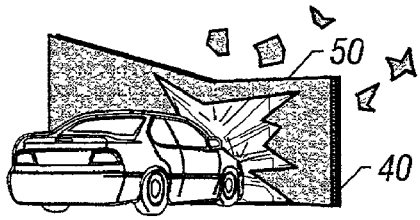
Figure 8D:
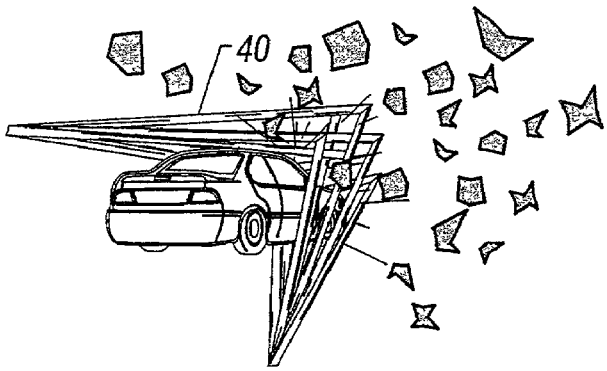

FIG. 7 illustrates a plurality of barriers 50 placed end-to-end and anchored by the ground anchors 60 to form a deceleration-limiting roadway barrier system 70. Such a roadway barrier system 70 may be installed alongside a racetrack or a roadway, according to some embodiments of the invention, to prevents spectators and pedestrians from entering the racetrack or roadway, and to keeps cars and other vehicles from leaving the racetrack or roadway. In some embodiments, the barriers 50 are arranged in a first row 72 and a second row 74, with each row being fully capable of decelerating a vehicle independently of the other row. The barriers 50 in the first row 72 are staggered relative to the barriers 50 in the second row 74, as shown, such that no two barriers are in register. Such an arrangement ensures that a vehicle that happens to collide at a junction 76 between two barriers in one of the rows and possibly splitting the two barriers will still be fully captured by a barrier in the other row.

In some embodiments the junction 76 between two barriers 50 may be in the form of a joint such as a tongue-and-grove joint or a dovetail joint (not expressly shown). The barriers may each have male portions and female portions to facilitate the quick removal and replacement of the barriers 50. Such joints allow the barriers to simply be slid in and out of connection with other barriers. For this purpose, a supply of barriers 50 may be made readily available in a nearby storage area (e.g., a warehouse) to replace used barriers as needed.

A supporting pole, pipe, or shaft 78 made of rigid, but easily shattered material such as wood, aluminum, PVC, or other suitable material may be spaced at various points along the roadway barrier system 70 to provide vertical support the first and second rows 72 and 74, respectively, of the roadway barrier system 70. Other suitable structures such as L-shaped brackets or braces may also be used to support the first and second rows 72 and 74.

FIGS. 8A–8D illustrate a vehicle crashing into one of the barriers 50 of the deceleration-limiting roadway barrier system 70. As the vehicle crashes into the barrier 50, the sacrificial panels and any supporting poles are broken away, and the vehicle is captured in the net 40. The forward momentum of the vehicle carries the net 40 forward and causes the lanyards attached thereto to be deployed. The lanyards, which are anchored by the ground anchors, operate to decelerate the vehicle and bring it to rest by absorbing the energy of the vehicle in the manner described above. Such an arrangement limits the maximum level of deceleration or G force experienced by the occupants of the vehicle to near some preset level no matter how fast the vehicle is traveling. In other words, the level of deceleration will be the same whether the vehicle impacts the barrier at 100 mph, 200 mph, or some other speed. Higher velocities, of course, will require a longer stopping distances. The maximum level of deceleration may be selected as needed to suit a particular application.

In some embodiments, the front sacrificial panel (see FIG. 5) of each barrier 50 are designed to withstand low level glancing impacts and bumps from vehicles that are usually encountered many times during a racing event or normal roadway traffic. In other words, the front sacrificial panel may be designed so that a breakup occurs only when a significant impact is encountered. For this purpose, the front sacrificial panel may have a smooth surface on the side facing the racetrack or roadway such that vehicles making a low level impact with the barrier 50 are simply deflected and allowed to continue.

Figure 9:
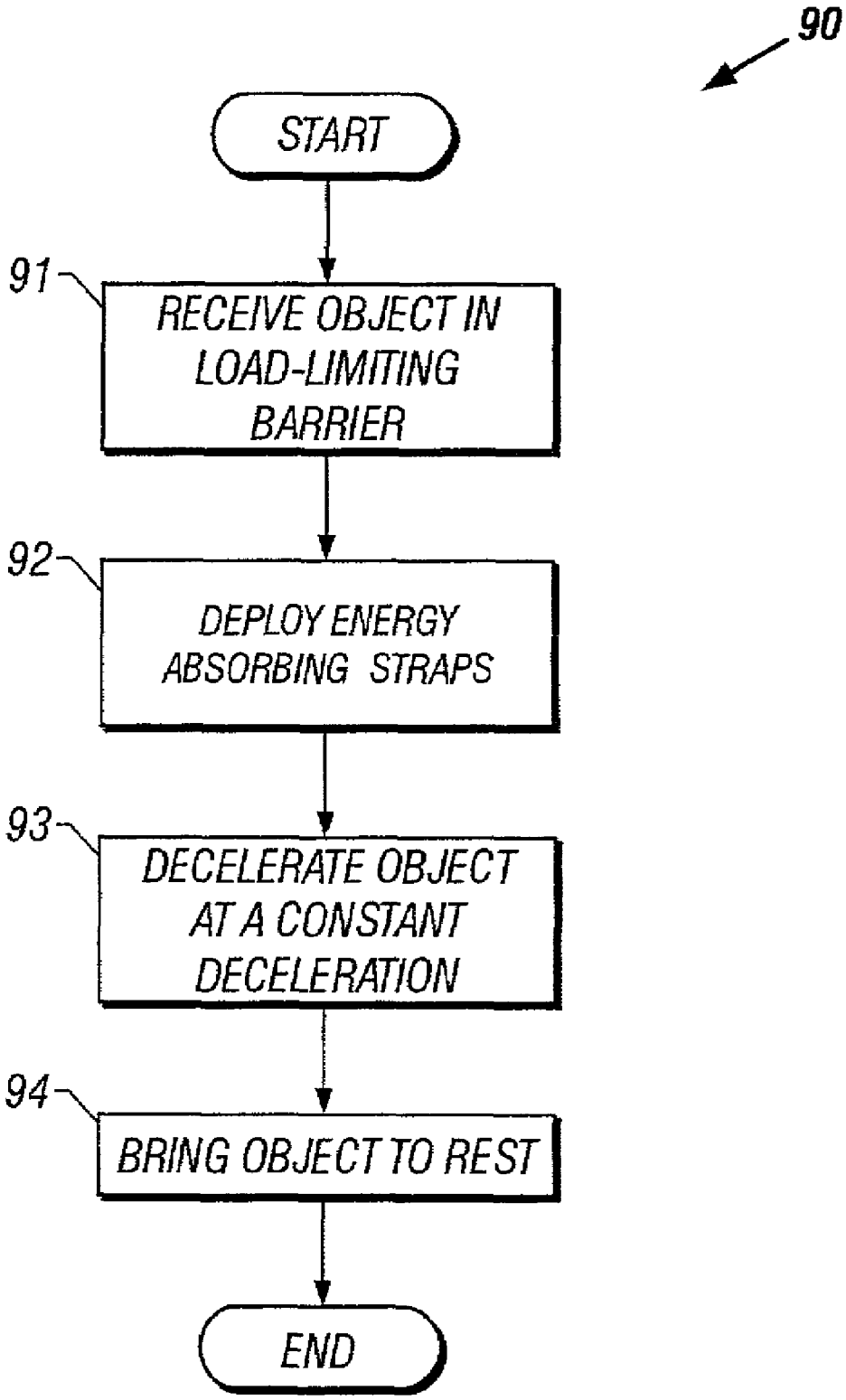
FIG. 9 illustrates a flow chart of a method of decelerating a moving body according to some embodiments of the invention.

FIG. 9 illustrates a method 90 of decelerating a moving object such as a vehicle. The method begins at step 91 when an object crashes or is otherwise received in a load-limiting barrier such as the deceleration-limiting barrier of the present invention. At step 92, the energy absorbing straps or lanyards of the barrier are deployed to decelerate the object. At step 93, the object is decelerated at a substantially constant deceleration by the energy absorbing straps or lanyards of the deceleration-limiting barrier system of the present invention. Finally, at step 94, the object is brought to rest after the energy thereof has been absorbed by the barrier system.

While a limited number of embodiments of the invention have been described, these embodiments are not intended to limit the scope of the invention as otherwise described and claimed herein. Variations and modifications from the described embodiments exist. For example, in some embodiments, the capture net may be a sheet instead of a net. Furthermore, in some embodiments, the loops in the energy absorbing strap may be bonded, adhered, or formed using Velcro™ instead of stitches to alleviate puncturing of the strap and thereby render the strap more amenable to reuse. Accordingly, the appended claims are intended to cover all such variations and modifications as falling within the scope of the invention.

What is claimed is:

1. A deceleration-limiting barrier adapted to be installed alongside a vehicular roadway for protecting occupants of vehicles that collide with the barrier, comprising:

a net;

a first and second sacrificial panel sandwiching the net therebetween wherein the first and second sacrificial panels are adapted to extend alongside the vehicular roadway and comprise a means for holding up the net in a vertical position;

a plurality of anchors coupled to the first and second sacrificial panels and wherein the plurality of anchors does not comprise a means for supporting the net in a vertical position; and a flexible strip arranged to secure the net to the plurality of anchors, with portions of the strip joined together in a manner as to be susceptible to being pulled apart under a load that is less than a load capacity of the strip.

2. The barrier of claim 1, wherein the portions of the strip are joined with fasteners having a tensile strength that is less than the tensile strength of the strip.

3. The barrier or claim 2, wherein the fasteners are stitched into the portions of the strip.

4. The barrier of claim 1, wherein the first sacrificial panel includes a smooth surface on one side, the first sacrificial panel comprising means for deflecting vehicles that collide only tangentially with the deceleration-limiting barrier.

5. The barrier of claim 1, wherein a plurality of barriers are placed end-to-end alongside a roadway.

6. The barrier of claim 1, wherein the strip provides a substantially constant level of deceleration.

7. The barrier of claim 1, wherein the strip provides a non-constant level of deceleration.

8. The deceleration-limiting barrier of claim 1 wherein the first and second sacrificial panels are made of a thin layer of epoxy, concrete or plywood, or combinations thereof.

9. A barrier for limiting decelerating of a moving body, comprising:

means for receiving and retaining the moving body;

means for anchoring the receiving and retaining means wherein the means for anchoring is not a means for supporting the means for receiving and retaining in a vertical position;

means for decelerating the moving body in a controlled manner to thereby limit the deceleration thereof to below a predefined maximum deceleration level; and a first and second sacrificial panel sandwiching the means for receiving and retaining therebetween and comprising a means for supporting the means for receiving and retaining in a vertical position.

10. The barrier of claim 9 wherein the first sacrificial panel is made of a thin layer of epoxy, concrete or plywood, or combinations thereof.

11. The barrier of claim 9, wherein the deceleration means provides a substantially constant level of deceleration.

12. The barrier of claim 9, wherein the deceleration means provides a non-constant level of deceleration.

13. A method of decelerating a vehicle moving along a vehicular roadway, comprising:

supporting a net with a first and second sacrificial panel that is also capable of deflecting moving vehicles colliding tangentially therewith such that no other vertical support for the net is required;

anchoring the first and second sacrificial panels to the ground;

breaking away the first sacrificial panel;

receiving the moving vehicle in the net;

deploying a plurality of energy absorbing straps attached to the net;

decelerating the moving vehicle-using the energy absorbing straps; and limiting the deceleration of the moving vehicle to a level below a predefined maximum deceleration level safe for occupants of the vehicle.

14. The method of claim 13, further comprising sandwiching the net between the first sacrificial panel and a second sacrificial panel.

15. The method of claim 13, further comprising decelerating the moving body at a substantially constant deceleration.

16. The method of claim 13, further comprising decelerating the moving body at a non-constant deceleration.

17. The method of claim 13 wherein the first and second sacrificial panels are made of a thin layer of epoxy, concrete or plywood, or combinations thereof.

18. A barrier for decelerating a moving body, comprising means for receiving and retaining the moving body;

means for anchoring the receiving and retaining means wherein the means for anchoring is not a means for supporting the means for receiving and retaining in a vertical position;

a first and second sacrificial panel sandwiching the means for receiving and retaining therebetween and comprising a means for supporting the means for receiving and retaining in a vertical position; and means for decelerating the moving body in a controlled manner to thereby limit the deceleration thereof to below a predefined maximum deceleration level, the means for decelerating the moving body comprising at least one flexible, energy absorbing strap connected intermediate the means for receiving and retaining the moving body and the means for anchoring the receiving and retaining means, the at least one strap having a plurality of loops formed therein, mutually spaced along the strap and interconnected by unstitched portions of the strap, each loop being formed of mutually adjacent lengths of the strap stitched together by sacrificial stitching formed between the mutually adjacent lengths of strap and defining stitched portions in the respective loops, the tensile strength of the strap being greater than that of the stitches, wherein the load capacity of the energy absorbing strap is expressed by the equation:

$$\text{Load}=Fr\cdot(Xm1+Xm2+Xm3+\ldots+Xmi)$$

wherein the energy absorbing stroke of each loop comprises the length of the respective stitched portion formed therein, and wherein the sum of Xm1, Xm2, Xm3, . . . , Xmi represents the total stroke provided by the individual loops, and wherein the load capacities of the loops differ.

19. The barrier of claim 18, the loops comprising means for applying successive decelerative forces upon a moving body impinging upon the means for receiving and retaining the moving body as the loops are ripped apart, the stitches of at least one of the loops being of greater tensile strength than those of at least one other loop, whereby the decelerative forces applied by the loop having stitches of greater tensile strength are greater than those applied by the at least one other loop.

20. The barrier of claim 19, wherein the energy absorbing strap comprises means for applying decelerative forces upon a moving body impinging upon the means for receiving and retaining the moving body as the loops are successively ripped apart.

21. The barrier of claim 18, wherein the energy absorbing strap comprises means for applying successively greater decelerative forces upon a moving body impinging upon the receiving means upon loops of successively greater load capacity being ripped apart.

22. A deceleration-limiting barrier adapted to be installed alongside a vehicular roadway for protecting occupants of vehicles that collide with the barrier, comprising:

a net;

a first and second sacrificial panel sandwiching the net therebetween, adapted to extend alongside the vehicular roadway, comprising a means for supporting the net in a vertical position, wherein the first sacrificial panel is formed of a smooth surface adapted to face the vehicular roadway and wherein the first sacrificial panel comprises a means for deflecting vehicles which collide only tangentially with the first sacrificial panel;

a plurality of anchors coupled to the first and second sacrificial panels and wherein the plurality of anchors does not comprise a means for supporting the net in a vertical position; and a flexible strip arranged to secure the net to the plurality of anchors, with portions of the strip joined together in a manner as to be susceptible to being pulled apart under a load that is less than a load capacity of the strip.

* * * * *